United States Patent [19]

Koshizuka et al.

[11] Patent Number: 4,970,119

[45] **Date of Patent: * Nov. 13, 1990**

[54] THERMAL TRANSFER RECORDING MEDIUM AND METHOD FOR PREPARING THE SAME

[75] Inventors: Kunihiro Koshizuka; Takao Abe, both of Hino, Japan

[73] Assignee: Konica Corporation, Tokyo, Japan

[ * ] Notice: The portion of the term of this patent subsequent to Nov. 21, 2006 has been disclaimed.

[21] Appl. No.: 145,223

[22] Filed: Jan. 19, 1988

[30] Foreign Application Priority Data

| | | | |
|---|---|---|---|
| Jan. 24, 1987 | [JP] | Japan | 62-14962 |
| Jan. 27, 1987 | [JP] | Japan | 62-16871 |
| Feb. 3, 1987 | [JP] | Japan | 62-23305 |
| Feb. 5, 1987 | [JP] | Japan | 62-25487 |
| Feb. 7, 1987 | [JP] | Japan | 62-26910 |
| Feb. 20, 1987 | [JP] | Japan | 62-37368 |

[51] Int. Cl.[5] ..... B41M 5/26

[52] U.S. Cl. ..... 428/411.1; 428/195; 428/484; 428/488.1; 428/488.4; 428/913; 428/914

[58] Field of Search ..... 428/216, 195, 207, 209, 428/211, 484, 488.1, 488.4, 913, 914, 411.1

[56] References Cited

U.S. PATENT DOCUMENTS

| | | | |
|---|---|---|---|
| 4,623,580 | 11/1986 | Koshizuka et al. | 428/488.4 |
| 4,651,177 | 3/1987 | Morishita et al. | 428/488.4 |
| 4,684,271 | 8/1987 | Wellman et al. | 428/913 |
| 4,783,360 | 11/1988 | Katayama et al. | 428/484 |

*Primary Examiner*—Pamela R. Schwartz

*Attorney, Agent, or Firm*—Frishauf, Holtz, Goodman & Woodward

[57] ABSTRACT

A thermal transfer recording medium having at least one peel layer on a support and at least one heat-softening layer on the peel layer, and containing a coloring material in at least one layer of the peel layer and heat-softening layer, wherein;

(i) the peel layer adjacent to the support contains a polyoxyethylene compound;

(ii) at least one heat-softening layer contains an ionomer;

(iii) at least one layer of the heat-softening layer has a breaking extension in the range of 70 to 200% at 27° C.; or (iv) at least one substantially colorless protective layer constituting an outermost layer is laminated on the heat-softening layer.

A method for preparing a thermal transfer recording medium, which comprises providing at least one peel layer on a support by hot-melt coating, and forming at least one heat-softening layer on the peel layer by water base coating.

23 Claims, 1 Drawing Sheet

THERMAL TRANSFER RECORDING MEDIUM AND METHOD FOR PREPARING THE SAME

FIELD OF THE INVENTION

This invention relates to a method for preparing a thermal transfer recording medium. More particularly, it relates to a thermal transfer recording medium that can form print of good quality even on rough paper having a paper surface of poor smoothness, and yet may hardly cause the blocking, and also can have a good correcting performance.

DESCRIPTION OF PRIOR ARTS

The thermal transfer recording processes is a process in which, using a thermal transfer recording medium (in general, an ink ribbon for thermal transfer recording) comprising a support and a hot-melting coloring material layer provided on this support and comprised of a coloring material dispersed in a hot-melting material, this coloring material layer is heated with a thermal head from the support side of the thermal transfer recording medium in the state that it is laid overlapping on a transferring medium (paper, in general), whereby the coloring material layer corresponding to the heated part is brought into a molten state and transferred on the transferring medium.

However, the process employing the thermal sensitive recording medium have had the problem that the print of sufficiently good quality can be formed with difficulty on a transferring medium (the so-called rough paper) having a poor surface smoothness.

This problem brings about a difficulty in instances in which the paper which is a transferring medium most widely used is used. More specifically, paper having a high smoothness is rather of special case, and usual paper have considerable irregularities on its surface because of fibers entangled each other. For example, the surface of rough paper having a Beck's smoothness of about 10 seconds comprises a great number of parts of 10 $\mu$m or more each in the depth from the top of a convex part to the bottommost part of a concave part. If the termal transfer is performed on such paper, the print density may be poor or part of print may be chipped, resulting in a poor print quality.

Moreover, in nowadays when the printing speed has been made higher with progress of thermal printing apparatus, the thermal transfer recording medium can not be said to be satisfactory only if it can give effect to a good print quality with regard to the transferring paper having a poor surface smoothness, and there are steadily increasing demands for a thermal transfer recording medium that can be used with a small heat supply from a thermal head, in other words, a thermal transfer recording medium having a high sensitivity and also having a superior high speed response.

Now, as a countermeasure for this improvement, there has been employed a process in which a layer called a peel layer is interposed between the support and the hot-melting coloring material layer to make it easy for the hot-melting coloring material layer to be peeled from the support (see Japanese Unexamined Patent Publication Nos. 224392/1984, 97888/1985, 187593/1985, 183192/1985, 115488/1985, etc.).

Such a thermal transfer recording medium, however, is generally prepared by utilizing the so-called hot-melt coating in which the components for forming the hot-melting coloring material layer are coated on the support in a molten state, or the so-called organic solvent process in which a solution obtained by dispersing or dissolving the constituent components in an organic solvent is coated. Accordingly, the hot-melting coloring material layer tends to be mingled with part of the peel layer to form a continuous layer having an unclear boundary between the both, resulting in no showing of the properties attributable to the respective layers, so that the print quality for the rough paper can not be improved. In instances in which the organic solvent coating process is utilized, it sometimes occurs that the organic solvent remains, and the thus remaining organic solvent causes "sticking" on the surface of the hot-melting coloring material layer, resulting in a lowering of the print quality for the rough paper also in such instances.

Also, the invention described in the above publications, although it comprises the multi-layer constitution, has been made based on the same idea as that for those having the single layer construction so far as the constitution of the ink layer itself is concerned. Thus, although it is possible that the peelability of the ink layer is improved by interposing the peel layer or the like, the fixing performance of the ink layer on a rough surface can have no difference from that in the conventional single layer ones, and therefore the ink layer may adhere only on the convex part of the surface of rough paper, or on the vicinity thereof, so that the void volume of the layer to be transferred becomes higher and thus it has been impossible to make print of good quality on the rough paper.

Incidentally, in the thermal transfer recording process, in addition to the performance that the printing can be performed in a high print quality on the transferring medium such as rough paper having a poor surface smoothness as mentioned above, there has come to be required the performance that, for example, clerical error portions or the like can be corrected with ease and the corrected part is kept clean. The removal of such clerical error portions is called "correction".

In the thermal transfer recording process, it is easy to remove by peeling the coloring material present on the surface part, since there fundamentally occurs no permeation of the coloring material into a deep part of the transferring medium.

In practice, however, there is a problem that, once the correction has been made, marks of print remain on the transferring medium, enabling no perfect correction. This is because, in order to improve the print quality on the transferring medium having a poor surface smoothness, the performance of a bonding material or the like has been improved so that the coloring material may reach a deep part of the concave part formed on the surface. Especially, it tends that, with the lowering of the surface smoothness of the transferring medium, a small amount of the coloring material may permeate into even a deep part of entangled fibers, making it difficult to make a perfect correction.

Accordingly, in the conventional thermal transfer recording mediums, in which the technique for performing the transfer in a high print quality on the transferring medium having a poor surface smoothness and the technique for making the correction excellently are in such a situation that they conflict with each other, it has been impossible to bring both of them into an improvement together.

SUMMARY OF THE INVENTION

This invention was made in order to eliminate the above problems, and a first object of this invention is to provide a thermal transfer recording medium that can make transfer in a high print quality on the transferring medium having a poor surface smoothness, not to speak of the transferring medium having an excellent surface smoothness.

A second object of this invention is to provide a thermal transfer recording medium on which the marks of transfer may hardly remain after the correction.

A third object of this invention is to provide a thermal transfer recording medium that may suffer less scumming and has a good blocking resistance.

Constitution of this invention, for achieving the above objects, is a process for preparing a thermal transfer recording medium, characterized by providing at least one peel layer on a support by hot-melt coating, and thereafter forming at least one heat-softening layer on said peel layer by water base coating.

The present inventors have made studies on the properties of the heat-softening layer formed for the purpose of improving the adaptability to rough paper, and, as a result, have found the following:

In general, when the layer containing a coloring material (hereinafter sometimes referred to merely as "ink layer") is peeled from a support by heating by means of a thermal head and transferred on a transferring medium (specifically, rough paper), the print quality is affected by;

(1) adhesion between the ink layer and the transferring medium;

(2) peelability of the ink layer from the support;

(3) cohesive force of the ink layer; and (4) breaking extension of the ink layer.

Then, in the thermal transfer recording medium prepared according to a conventional process, these properties of the ink layer tend to depend primarily on the materials to be used.

For example, the cohesive force of the ink layer correlates with the adhesion or breaking extension thereof, so that the breaking extension and adhesion of the ink layer tend to be lowered if the cohesive force is intended to be suppressed to a certain degree. It was therefore found to be very difficult to control all of the above properties of the ink layer to an appropriate range only by selecting the materials.

The present inventors discovered that the print quality on the rough paper can be improved not by selecting the materials constituting the ink layer as conventionally done, but by the manner by which it is made, and thus reached this invention.

Another constitution of this invention, for achieving the above objects, is a thermal transfer recording medium having at least one peel layer on a support and at least one heat-softening layer on said peel layer, and containing a coloring material in at least one layer of said peel layer and heat-softening layer, characterized in that the peel layer adjacent to said support contains a polyoxyethylene compound.

The thermal transfer recording medium is basically comprised of a peel layer and a heat-softening layer laminated on a support in this order.

FIG. 1 illustrates a cross-section of a preferred example of the thermal transfer recording medium of this invention. In FIG. 1, there is provided a peel layer 2 on a support 1, and a heat-softening layer 3 on the peel layer 2.

Herein, the peel layer is basically a layer containing a hot-melting material and a thermoplastic resin, and refers to a layer in which the properties of the layer is governed by the attributes possessed by the hot-melting material. On the other hand, the heat-softening layer is a layer containing a thermoplastic resin and a hot-melting material, and is a layer in which the properties of the layer is governed by the attributes possessed by the thermoplastic resin. The coloring material may be contained in any one of the peel layer and heat-softening layer, but usually contained in the heat-softening layer.

In the thermal transfer recording medium of this invention, the above peel layer and heat-softening layer each may not be required to be comprised of one layer, and may also be those in which two or more peel layers having a different content proportion of components are laminated on the support and two or more heat-softening layers are laminated on this peel layers. They may also be those in which two or more layers of the peel layer and the heat-softening layer, respectively, may be alternately laminated. In these instances, among the peel layers, at least the peel layer adjacent to the support may contain the polyoxyethylene compound.

Provided that the description set out below for the thermal transfer recording medium of this invention will be made in line with an embodiment comprising a support and a peel layer and a heat-softening layer laminated in this order on this support, which is an embodiment preferred as the thermal transfer recording medium of this invention. Accordingly, it is needless to say that this invention is not the one comprised of only the three layers including the support, the peel layer and the heat-softening layer.

Further constitution of the invention, for achieving the above objects, is a thermal transfer recording medium having at least one peel layer on a support and at least one heat-softening layer laminated on said peel layer, and containing a coloring material in at least one layer of said peel layer and heat-softening layer, characterized in that at least one heat-softening layer contains an ionomer.

The thermal transfer recording medium of this invention has at least one peel layer on a support and at least one heat-softening layer on this peel layer, and a most simple constitution is such that a peel layer and a heat-softening layer are laminated on the support in this order. For example, the layer constitution may be such that a peel layer, a first heat-softening layer and a second heat-softening layer is laminated in this order, or that peel layers and heat-softening layers are alternately laminated in multi-layers in such order of a first peel layer, a first heat-softening layer, a second peel layer, a second heat-softening layer, and so on. In this instance, among the heat-softening layers, at least one layer is required to contain the ionomer, and this layer may preferably comprise an uppermost layer. Also, it is particularly preferable that all of the heat-softening layer contain the ionomer. Constituting like this, the print quality more highly tends to be improved.

The coloring material may also be contained in any of the above peel layer and heat-softening layer, but particularly preferred in this invention is an embodiment in which the coloring material is contained in the heat-softening layer.

Still further constitution of this invention, for achieving the above objects, is a thermal transfer recording medium characterized by being provided on a support with at least each one layer of a peel layer and a heat-softening layer, and having a breaking extension in the range of from 70 to 200% at 27° C. in respect of at least one layer of said heat-softening layer.

The present inventors made studies on the properties of the ink layer that are required for carrying out good printing on the rough paper, and, as a result, discovered that the peelability of the ink layer from the support and the breaking extension of the ink layer are important factors for giving an influence to the adaptability to rough paper.

Accordingly, the thermal transfer recording medium of this invention has at least each one layer of the peel layer and the heat-softening layer, and has a breaking extension in a specific range in respect of the heat-softening layer.

Still further constitution of this invention, which has been made for achieving the above objects, is a thermal transfer recording medium comprising a lamination of at least one peel layer provided on a support, at least one heat-softening layer provided on said peel layer, and at least one substantially colorless protective layer provided on said heat-softening layer and constituting an outermost layer.

Still further constitution of this invention, for achieving the above objects, is a process for preparing a thermal transfer recording medium, comprising providing by coating, at least one peel layer on a support, and forming by coating, at least one heat-softening layer on said peel layer, characterized in that said heat-softening layer is formed by coating on said peel layer an aqueous emulsion comprising components for forming said layer, and said aqueous emulsion is prepared by previously mixing at least a part of a hot-melting material and a thermoplastic resin which form said heat-softening layer, substantially in the absence of water to obtain a mixture, followed by dispersion of said mixture in water.

In the thermal transfer recording medium according to the process of this invention, a coloring material is contained in at least one of the above peel layer and heat-softening layer.

DESCRIPTION OF PREFERRED EMBODIMENTS

Figure 1:
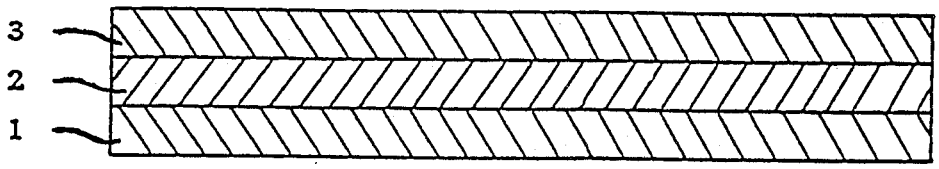
FIG. 1 is a cross-section illustrating a preferred example of the thermal transfer recording medium of this invention.

This invention will be described below in greater detail.

This invention is, in summary, a thermal transfer recording medium comprising a peel layer, a heat-softening layer, and a substantially colorless protective layer (a layer substantially containing no coloring material), laminated in succession on a support.

Support

The support used in the thermal transfer recording medium of this invention may preferably have a good fastness to heat and have a high dimensional stability and surface smoothness.

Materials therefor include, for example, papers such as ordinary paper, condenser paper, laminated paper and coated paper, or films of resins such as polyethylene, polyethylene terephthalate, polystyrene, polypropylene and polyimide, paper/resin film composites, and metallic sheets such as aluminum foil, any of which can be preferably used.

The support may preferably have a thickness of 60 μm or less in usual cases, in order to attain a good thermal conductivity, and particularly preferably in the range of from 1.5 to 15 μm.

The back side of the support of the thermal transfer recording medium of this invention may have any constitution, and may be provided with a backing layer for the purpose of preventing the sticking.

Preparation of peel layer

On this support, there is provided by coating, at least one peel layer. The peel layer can be provided on the support in two or more layers, but, in this invention, the peel layer may preferably be comprised of one layer.

This peel layer usually contains a hot-melting material and a thermoplastic resin, and, in certain instances, contains a coloring material, which is a layer chiefly governed by the attributes possessed by the hot-melting material, and is a layer chiefly having the action of controlling the adhesion between the heat-softening layer and the support.

The hot-melting material herein used may preferably be a solid or semisolid material having a melting point (a value measured by Yanagimoto MJP-2 Type) of 40° to 150° C.

Specific examples may include vegetable wax such as carnauba wax, Japan wax, Auricurie wax and Espar wax;

animal wax such as beeswax, insect wax, shellac wax and whale wax;

petroleum wax such as paraffin wax, microcrystalline wax, polyethylene wax, ester wax and acid wax;

waxes such as mineral wax such as montan wax, ozokerite and ceresine;

higher aliphatic acids such as palmitic acid, stearic acid, margaric acid and behenic acid;

higher alcohols such as palmityl alcohol, stearyl alcohol, behenyl alcohol, marganyl alcohol, melissyl alcohol and eicosanole;

higher aliphatic esters such as cetyl palmitate, melissyl palmitate, cetyl stearate and melissyl stearate;

amides such as acetamide, propionic acid amide, palmitic acid amide, stearic acid amide and amide wax; and higher amines such as stearylamine, behenylamine and palmitylamine, and these may be used alone or may be used in combination.

Examples of the thermoplastic resin may include resins such as polyamide resins, polyester resins, polyurethane resins, polyolefin resins, acrylic resins, vinyl chloride resins, cellulose resins, rosin resins, ionomer resins and petroleum resins;

elastomers such as natural rubber, styrene butadiene rubber, isoprene rubber and chloroprene rubber;

rosin derivatives such as ester gum, rosin maleic acid resin, rosin phenol resin and hydrogenated rosin; and polymeric compounds softening at 50° to 150° C. such as phenol resin, terpene resin, cyclopentadiene resin and aromatic hydrocarbon resins.

Among these, preferred thermoplastic resin may include acrylic resins.

The acrylic resins can be obtained, for example, by subjecting to emulsion polymerization a monobasic carboxylic acid such as acrylic acid and methacrylic acid, or an ester thereof, and at least one kind of monomer copolymerizable with these. The carboxylic acid monomer used in that occasion may include methyl, ethyl, isopropyl, butyl, isobutyl, amyl, hexyl, octyl, 2-ethylhexyl, decyl, dodecyl, hydroxyethyl and hydroxyethyl ester of acrylic acid or methacrylic acid, etc. The copolymerizable monomer may include vinyl acetate, vinyl chloride, vinylidene chloride, malaic anhydride, fumaric anhydride, styrene, 2-methylstyrene, chlorostyrene, acrylonitrile, vinyl toluene, N-methylol acrylamide, N-methylol methacrylamide, N-butoxymethyl acrylamide, N-butoxy methacrylamide, vinyl pyridine and N-vinyl pyrrolidone, or the like, and can be selected from one of more kinds of these.

Also usable as the thermoplastic resin is diene copolymers. Specifically, they may include emulsion polymers of diene monomers such as butadiene, isoprene, isobutyrene and chlorobutyrene, with the above copolymerizable monomers. Specific examples of this emulsion polymers include a butadiene/styrene polymer, a butadiene/styrene/vinyl pyridine polymer, a butadiene/acrylonitrile polymer, a chloroprene/styrene polymer and a chloroprene/acrylonitrile polymer, or the like.

Preferred polymers may further include ethylene copolymers. For example, there is included a ethylene/vinyl acetate copolymer, an ethylene/ethyl acrylate copolymer, an ethylene/methyl methacrylate copolymer, an ethylene/isobutyl acrylate copolymer, an ethylene/acrylic acid copolymer, and ethylene/vinyl alcohol copolymer, an ethylene/vinyl chloride copolymer and an ethylene/acrylic acid metallic salt copolymer, or the like.

As the above coloring material, there can be used pigments such as inorganic pigments and organic pigments, and dyes, that are usually used.

Examples of the above inorganic pigments may include titanium dioxide, carbon black, zinc oxide, Prussian blue, cadmium sulfide, iron oxide, and chromate of lead, zinc, barium and calcium, or the like. Examples of the above organic pigments may include pigments of an azo type, a thioindigo type, an anthraquinone type, an anthoanthrone type and a triphenodioxazine type, vat dye pigments, phthalocyanine pigments, for example, copper phthalocyanine and its derivatives, and quinacridone pigments, or the like.

Examples of the organic dyes may include acidic dyes, direct dyes, disperse dyes, oil-soluble dyes and metallic oil soluble dyes, or the like.

There is no limitation in the content of the hot-melting material in the peel layer, but it may be contained usually in an amount of 50% by weight or more (preferably in the range of from 50 to 97% by weight), more preferably in the range of from 60 to 97% by weight, based on the total weight of this hot-melting material and the thermoplastic material.

In this peel layer, the coloring material may be contained or may not be contained. When it is contained, it is set usually in an amount of 30% by weight or less, preferably in the range of from 5 to 30% by weight, based on the total weight of the layer.

Besides this, polyoxyethylene compounds, inorganic or organic fine particles (such as metal powder and silica gel) and oils (such as linseed oil) can be also added in the peel layer.

In this instance, the polyoxyethylene compound used in this invention is a compound having a polyoxyethylene chain represented by the following general formula:

$$-(-CH_2CH_2O-)_n-$$

Provided that, in the formula, n represents an integer of 2 or more.

The compound having this polyoxyethylene chain may preferably include substances having a melting point in the range of from 30° to 120° C. and being solid at room temperature, and more preferably include those having a melting point in the range of from 40° to 100° C.

The polyoxyethylene compound in this invention will be described in greater detail.

the polyoxyethylene compound used in this invention can be grouped in polyethylene glycol and a polyethylene glycol derivative.

The polyethylene glycol derivative will be first described.

The polyethylene glycol derivative used in this invention can be usually prepared by reacting one or two alcohol —OH group(s) of polyethylene glycol with a variety of organic compounds according to a usual method. In this instance, the resulting polyethylene glycol derivative may necessarily contain an ether bond or an ester bond, as well as a bond with a sulfur atom or nitrogen atom, a urethane bond or other various bonds, depending on the type of the organic compound to be used.

The structure of the polyethylene glycol derivative is determined based on the molecular design such as molecular weight, miscibility with other binders, and polar groups, in order to prevent breedout and make appropriate the cohesive failure or viscosity. In this invention, examples of the polyethylene glycol derivative may include those containing an ether bond and those containing an ester bond.

Preferred as the above polyoxyethylene compound are those comprising the above polyoxyethylene chain moiety having a molecular weight in the range of from 200 to 20,000, and, when it has a plurality of polyoxyethylene chain moieties in the molecule, in the range of from 200 to 20,000 in its total molecular weight.

Next, examples of the polyoxyethylene compound used in this invention are listed below.

(1) Polyethylene glycol:

Here may be included polyethylene glycol and diethylene glycol, comprising the repeating unit moiety represented by $-(-CH_2CH_2O-)-$ having an average molecular weight in the range of from 100 to 20,000 (specifically, 20,000, 12,000, 9,000, 1,000, 400 and 100).

(2) Mono- or diester derivatives of polyethylene glycol:

In instance in which they are derived by a fatty acid, this fatty acid may preferably have 10 to 50 carbon atoms, and particularly preferable fatty acid are those having carbon atoms in the range of from 10 to 19.

Examples of this fatty acid may include capric acid, undecanoic acid, lauric acid, tridecanoic acid, myristic acid, pentadecanoic acid, palmitic acid, margaric acid, stearic acid, nonadecanoic acid, arachic acid, heneicosanoic acid, behenic acid and mono- or diester derivatives of tricosanoic acid, lignoceric acid or the like. Among these, preferred are nonadecanoic acid, arachic acid, heneicosanoic acid, behenic acid, tricosanoic acid and mono- or diester derivatives of lignoceric acid. Of course, there can be also used mono- or diester derivatives of polyethylene glycol, derived from various organic acids other than these.

The above mono- or diester derivatives of polyethylene glycol may include linear monoeneic acid, di-, tri- or tetraenic acid, synthetic aliphatic acids, tertiary aliphatic acids, branched aliphatic acids, dimeric acids, dibasic acids, polybasic acids, oxycarboxylic acids, aliphatic chlorides, aliphatic acid anhydrides, polycarboxylic acids, and other compounds having a singular or plural number of carboxyl group(s) in the molecule. Also, regarding the diester derivatives, the diester moieties may be the same or different.

there may be more specifically includes;

polyethylene glycol monobehenate (PEG: 4,000);

polyethylene glycol distearate (PEG: 6,000);

polyethylene glycol monopalmitate (PEG: 600);

polyethylene glycol dibehenate (PEG: 14,000);

polyethylene glycol laurate (PEG: 100); etc.

The numerical values described in the parentheses at the ends of the above compounds indicate an average molecular weight of the $-(-CH_2CH_2O-)_n-$ moiety (PEG moiety) (hereinafter similarly indicated).

(3) Ether derivatives of monoalkyl or arylalkyl ethers of polyoxyethylene ether (compounds in which one —OH group of polyethylene glycol has been subjected to ether derivation):

The above ethers may preferably have 6 or more carbon atoms, and particularly preferred are polyoxyethylene ethers of an alkyl or alkylaryl, having 18 to 50 carbon atoms.

These may also be those in which the alkyl is linear or branched, or those substituted with a halogen atom.

It is still also possible to use polyoxyethylene ethers of unsaturated hydrocarbons, synthetic alcohols, oxycarboxylic acids or nitrogen-containing or sulfur-containing compounds.

There may be specifically included;

polyethylene glycol mono-p-nonylphenyl ether (PEG: 900);

polyethylene glycol monobehenyl ether (PEG: 6,000);

polyethylene glycol monocetyl ether (PEG: 2,000);

polyethylene glycol monooleyl ether (PEG: 4,000); etc.

(4) Ether or ester derivatives of the monoether derivatives in the above (3):

Namely, they are the compounds in which the remaining —OH group of the ether derivatives of monoalkyl or arylalkyl ethers of polyoxyethylene ether has been subjected to ether derivation or ester derivation.

Here, the ester derivation is based on the instance of the above (2), and the ether derivation is based on the instance of above (3).

There may be specifically included;

monobehenate of polyethylene glycol mono-p-nonylphenyl ether (PEG: 800);

monostearate of polyethylene glycol monostearyl ether (PEG: 9,000);

polyethylene glycol dibehenyl ether (PEG: 6,000);

polyethylene glycol monooleyl ether monobehenyl ether (PEG: 4,000); etc.

(5) Polyoxyethylene ether derivatives of polyhydric alcohol:

Namely, here are included compounds having two or more of alcohol —OH group in the molecule, for example, glycerol, polyglycerol, propylene glycol, pentaerythritol, sorbitan(1,5-sorbitan, or 1,4- or 3,6-sorbitan, isosorbide), mannitol, and other polyvinyl alcohol (poval) having a molecular weight of 800 or less, also including polyoxyethylene derivatives of a compound in which any one, or two or more, of alcohol —OH group(s) in the molecule of these has or have been subjected to ester derivation and/or ether derivation based on the above (2) and/or the above (3).

The present polyoxyethylene ether derivatives are those having a singular or plural number of polyoxyethylene chain(s) in the molecule, and may preferably be those in which one end(s) of the polyoxyethylene chain(s) has or have been subjected to ester derivation and/or ether derivation based on the above (2) and/or the above (3).

They may also be those having the structure in which two or more of polyhydric alcohol have been bonded to each other, or those having the structure in which they have been cross-linked with a polyoxyethylene chain.

There may be specifically included;

polyoxyethylene monostearate of glycerol;

di(polyoxyethylene monostearate) of glycerol;

polyoxyethylene monobehenyl ether of sorbitan monobehenate;

polyoxyethylene oleate of butyl alcohol;

a block copolymer of polypropylene glycol with polyoxyethylene glycol;

polyoxyethylene ether of polystearate of polyglycerol;

polyoxyethylene ether behenate of pentaerythritol distearyl ether;

polyoxyethylene ether of sorbitan ester;

polyoxyethylene ether of pentaerythritol;

polyoxyethylene ether of polyglycerol ester;

ester of polyoxyethylene ether of butyl alcohol ester;

polyoxyethylene ether of mannitol ester; etc.

(6) Polyoxyethylene derivatives of a molecule containing a sulfur atom or nitrogen atom:

Here may be specifically included alkylthiopolyoxyethylene ethers, polyoxyethylene fatty acid amide and polyoxyethylene alkylamines, or the like.

(7) Polyoxyethylene derivative of a polymer or copolymer:

Here may be specifically included alkylarylformaldehyde condensed polyoxyethylene ethers, polyoxyethylene ether esters of a copolymer, and polyoxyethylene derivatives of an $\alpha$-olefin maleic anhydride copolymer, or the like.

(8) Polyoxyethylene block polymers with synthetic polymers such as polyester and polyurethane.

(9) Compounds assuming an anionic property:

Here may be specifically included anionic active agents containing polyoxyethylene, such as carbonates of a polyoxyethylene alkyl(allyl) ether, sulfates of a polyoxyethylene fatty acid ester, sulfates of a polyoxyethylene alkyl(allyl) ether, phosphates of a polyoxyethylene alkyl(allyl), phosphates of a polyoxyethylene alkyl(allyl) amide and carboxylates of a polyoxyethylene fatty acid ester, or the like.

(10) Compounds assuming a cationic property:

Here may be specifically included cationic active agents and amphoteric surface active agents containing polyoxyethylene, such as alkyl(allyl) polyoxyethylene ether ammonium salts and polyoxyethylene hydroxylammonium salts, or the like.

Of the polyoxyethylene compounds of the above (1) to (10), preferred are mono- or diester derivatives of polyethylene glycol in the above (2) and ether derivatives of monoalkyl and arylalkyl ethers of polyoxyethylene ether in the above (3). Among these, particularly preferred are polyoxyethylene monobehenyl ether and polyoxyethylene distearyl ester.

The content of the above polyoxyethylene compound in the peel layer may preferably be in the range of from 1 to 50% by weight, particularly preferably from 4 to 30% by weight, based on the components constituting this layer.

It is presumed that the addition of this polyoxyethylene compound may broaden the latitude of the environmental temperature at which printing can be carried out for the thermal transfer recording medium, so that the thermoplastic resin that governs the properties of the heat-softening layer enables the transfer without producing any void or the like on the rough paper.

It is further considered that the addition of this polyoxyethylene compound may also broaden the latitude of the application energy by which printing can be carried out for the thermal transfer recording medium, so that a good print quality can be attained in cooperation with the broaden latitude of the environmental temperature at which the printing can be carried out as mentioned above.

This invention also includes the embodiment in which two or more peel layers are laminated on a support and two or more heat-softening layers are further laminated thereon, the embodiment in which a peel layer, a heat-softening layer, a peel layer and so on are laminated in succession on a support, etc. In such instances, the polyoxyethylene compound should be made to be contained in at least the peel layer adjacent to the support (preferably in all of the peel layers).

The peel layer may have a film thickness of usually 0.5 to 4 μm, preferably 1.0 to 2.5 μm.

It is desirable for the amount of mixing the respective components, the kind of the components, etc. to be so controlled that the viscosity of the peel layer at 100° C. may fall in the range of from 2 to 1,000 cps.

This peel layer can be coated by employing hot-melt coating.

The hot-melt coating is a process in which the components constituting this layer are mixed and the resulting mixture is brought into a molten state and coated. Here, the heating may be carried out at a temperature at which the hot-melting material which is a principal component for forming this layer is brought into a molten state, and usually at 150° C. or less. The molten component can be coated by employing a known process such as a coating process using a wire bar.

In the above hot-melt coating, it is also possible, for the purpose of controlling viscosity or the like, to mix an organic solvent of about less than 20% by weight based on the components used.

Preparation of heat-softening layer

In the process for preparing the thermal transfer recording medium of this invention, at least one heat-softening layer is next formed on the above peel layer by water base coating.

This heat-softening layer is a layer chiefly comprised of a thermoplastic resin and a hot-melting material, and optionally further containing a coloring material, but, unlike the above peel layer, a layer chiefly governed by the attributes possessed by the thermoplastic resin among these components. Accordingly, the mixing proportional of the thermoplastic resin and hot-melting material in the heat-softening layer can be set appropriately within the range in which the attributes thereof can be maintained. However, in order for this layer to achieve the fixing of the coloring material on the transferring medium in a good state, the thermoplastic resin may preferably be contained in an amount of 50% by weight or more (desirably in the range of from 50 to 97% by weight) based on the total weight of the thermoplastic resin and hot-melting material that form this layer.

As the hot-melting material, thermoplastic resin and coloring material used here, those used in the above peel layer can be used.

Of the all sorts of the hot-melting materials listed for the above peel layer, preferred for the heat-softening layer are waxes melting at 40° to 150° C.

The proportion for the content of the hot-melting material and the thermoplastic resin in the heat-softening layer can be set appropriately so that the properties of this layer may be governed by the attributes possessed by the thermoplastic resin, taking account of the kinds and properties of the thermoplastic resin and hot-melting material to be used.

However, since the chief action of this thermoplastic resin when used is to fix the coloring material on the transferring medium, the thermoplastic resin may preferably contained in an amount of 50% by weight based on the total amount of the components for forming this layer (except for the coloring material, however), for the purpose of retaining this action.

This heat-softening layer usually contains the coloring material. In this invention, as the coloring material, usual materials can be used. The coloring material most widely used in thermal transfer recording mediums is carbon black, and carbon black usually used can be used also in this invention.

In this invention, however, pigments such as inorganic pigments and organic pigments and dyes can be used besides carbon black.

The above inorganic pigments may include those exemplified for the above peel layer.

In this heat-softening layer, the coloring material may preferably be contained in the range of from approximately 5 to 35% by weight based on the total weight of the hot-melting material and thermoplastic resin contained in this layer.

In the water base coating of this heat-softening layer, preferably employed is a method in which an aqueous emulsion containing the thermoplastic resin, heat-softening material and coloring material is prepared and this is coated.

This aqueous emulsion can be prepared, for example, by mixing aqueous emulsions obtained by separately emulsifying the above hot-melting material, thermoplastic resin, coloring material and so forth, respectively.

Here, the aqueous emulsion of the hot-melting material, thermoplastic resin and coloring material can be prepared emulsifying them in water according to a conventional process such as a phase inversion process, a high pressure emulsification process and an ultrasonic dispersion process, in a system containing an emulsifying agent. As the emulsifying agent, there can be used any of nonionic emulsifying agents, anionic emulsifying agents, cationic emulsifying agents and amphoteric emulsifying agents.

It is desirable for this aqueous emulsion to contain a fluorine type surface active agent in addition to the emulsifying agent. The fluorine type surface active agent can effectively prevent the blocking phenomenon in the heat-softening layer, and at the same time has the action of improving the affinity of the aqueous emulsion for the peel layer to effectively prevent the so-called "cissing" at the time of the coating.

As the fluorine type surface active agent, it is preferable to use the compounds represented respectively by the following formula (I) to (VI).

$C_nF_{2n+1}SO_3M$ Formula (I)

$C_nF_{2n+1}SO_2N(CH_2CH_2O)_mH$ (R¹) Formula (II)

$C_nF_{2n+1}SO_2N(R^1)-Z-OSO_3M$ Formula (III)

$C_nF_{2n+1}SO_2N(R^1)-Z-OPO(OH)_2$ Formula (IV)

$C_nF_{2n+1}SO_2N(R^1)-Z-COOM$ Formula (V)

$C_nF_{2n+}CONH-Z(R^3)-N^+(R^1)-R^2.X^-$ Formula (VI)

In the above formulas (I) to (VI), M represents an alkali metal or an ammonium group, and $R^1$ represents a hydrogen atom or an alkyl group having 1 to 20 carbon atoms. $R^2$ and $R^3$ each represent an alkyl group having 1 to 20 carbon atoms, and may be the same or different. Z represents a divalent combining group, preferably an alkylene group or an arylalkylene group. X represents an anion residual group, n represents an integer of 3 to 20, and m represents an integer of 2 to 20.

Of these, preferred are the compounds of formulas (I), (II), (III) and (V), and particularly preferred are the compounds represented by formulas (I) and (III).

Typical examples of the fluorine type surface active agent used in this invention are shown below.

$C_8F_{17}SO_3K$ I-1

$C_8F_{17}SO_3Na$ I-2

$C_8F_{17}SO_3Li$ I-3

$C_8F_{17}SO_3NH_4$ I-4

$C_6F_{13}SO_3K$ I-5

$C_6F_{13}SO_3NH_4$ I-6

$C_8F_{17}SO_2N(CH_2CH_2O)_{11}H$ II-1

$C_8F_{17}SO_2N(C_2H_5)(CH_2CH_2O)_{14}H$ II-2

$C_8F_{17}SO_2N(CH_3)(CH_2CH_2O)_{16}H$ II-3

$C_8F_{17}SO_2NHCH_2CH_2OSO_3Na$ III-1

$C_8F_{17}SO_2N(C_2H_5)CH_2CH_2OSO_3Na$ III-2

$C_8F_{17}SO_2NH_2C_2COONa$ V-1

$C_8F_{17}SO_2N(C_2H_5)CH_2COOK$ V-2

-continued $C_8F_{17}SO_2N(C_4H_9)CH_2CH_2COOK$ V-3

$C_7F_{15}CONHCH_2CH_2CH_2N^+H(CH_3)_2Cl^-$ VI-1

$C_9F_{19}CONHCH_2CH_2CH_2N^+(CH_3)_3.Cl^-$ VI-2

$C_7F_{15}CONHCH_2CH_2CH_2N^+(CH_3)_3.I^-$ VI-3

$C_8F_{17}SO_2N(CH_3)(CH_2CH_2O)_5SO_3K$ III-3

$C_8F_{17}SO_2N(C_2H_5)CH_2CH_2OPO(OH)_2$ IV-1

$C_8F_{17}SO_2N(C_{12}H_{25})CH_2OPO(OH)_2$ IV-2

$C_8F_{17}SO_2N(C_{12}H_{25})CH_2CH_2OPO(OH)_2$ IV-3

The content of the fluorine type surface active agent in this layer may preferably be 0.05 to 3% by weight, particularly preferably 0.1 to 2% by weight, based on the total solids in the heat-softening layer. In instances in which there are provided a plural number of heat-softening layers, the content in an upper layer (a layer farther from the support) may preferably be made to be more than the content in a lower layer (a layer nearer to the support). Making higher the content of the fluorine type surface active agent in the upper layer tends to improve the blocking resistance.

The ionomer contained as an embodiment of this invention in the heat-softening layer in the thermal transfer recording medium will be described below.

Here, the ionomer refers to a copolymer of ethylene containing a carboxyl group, wherein a metallic ion bond has been introduced between the polymer backbone chains by use of an alkali metal or an alkaline earth metal.

The copolymer of ethylene containing a carboxyl group may include, for example, copolymers of acrylic acid, methacrylic acid or the like with ethylene.

The process for preparing this ionomer is already known, and it can be obtained, for example, by copolymerizing ethylene with methacrylic acid, followed by cross-linking with Mg ions.

In this invention, the ionomer is used as an aqueous emulsion.

The above ionomer in the heat-softening layer may preferably contained in the proportion of from 5 to 50% by weight, particularly preferably from 10 to 30% by weight.

The heat-softening layer in the thermal transfer recording medium of this invention is formed into the layer by coating an aqueous emulsion comprising the above thermoplastic resin, hot-melting material, ionomer and other components for constituting this layer.

There can be also used ionomers dissolved, dispersed or emulsified in water according to a usual method.

And, the ionomer contained in this heat-softening layer is a resin which in itself is tough and has a good stretchability. Moreover, in the heat-softening layer of the thermal transfer recording medium of this invention, this ionomer is contained in this layer by carrying out water base coating with use of the aqueous emulsion, forming particles together with the components for constituting this layer.

Accordingly, viewing microscopically, this particles respectively independently move to the transferring medium when the thermal transfer is carried out. Thus, for example, as in the case when coated by utilizing the hot-melt coating, less tailing may be caused at the printed part because of the good stretchability attributable to the ionomer, making it possible to make print of good quality.

In this invention, it is preferred that at least one layer for each of the peel layer and the heat-softening layer is provided and at least one layer of said heat-softening layers has a breaking extension at 27° C. in the range of from 70 to 200%.

Making the breaking extension of the heat-softening layer to be in the above range, a uniform film of heat-softening layer is formed between convex part and convex part on the surface of the transferring paper, and thus it becomes possible to make print of good quality on the transferring paper having a poor surface smoothness. Therefore, if the breaking extension is less than 70%, the heat-softening layer may be cut at a position between convex parts on the surface of the transferring paper to cause an increase in the void volume, so that the print density of the letters reproduced may be insufficient or part of an image may be chipped to lower the print quality. On the other hand, the breaking extension of higher than 200% may result in an overly high cohesive force of the heat-softening layer, so that the letters reproduced may lack in edge sharpness or there may be caused a stringing phenomenon in the shape of a beard.

In the instance in which there are provided two or more heat-softening layers, at least the outermost layer of the heat-softening layers may preferably have the breaking extension in the above range, and, particularly preferably, all of the heat-softening layers may have the breaking extension in the above range.

Manners by which the breaking extension is made to be in the above range may include, for example, a method in which the kinds or mixing proportion of the thermoplastic resin and hot-melting material is controlled.

This heat-softening layer is a layer chiefly comprised of the thermoplastic resin and the hot-melting material, but, unlike the above peel layer, a layer chiefly governed by the attributes possessed by the thermoplastic resin among these components. Accordingly, in order to control the breaking extension of this layer so as to be in the above range and also bring the coloring material into good fixing on the transferring medium, the thermoplastic resin may preferably be contained in an amount of 50% by weight or more (preferably in the range of from 60 to 97% by weight) as mentioned above, based on the total weight of the thermoplastic resin and hot-melting material which form this layer.

To describe next the aqueous emulsion comprising the components for forming the heat-softening layer of this invention, this aqueous emulsion may contain, for example, a thickening agent such as sodium polyacrylate and a material for improving the surface slip property, such as colloidal silica, for the purpose of controlling the viscosity. Besides these, to the aqueous emulsion, a water-soluble polymer may be previously added in its aqueous phase. For example, typical examples of the water-soluble polymer may include polyvinyl pyrolidone, polyvinyl alcohol, water-soluble polyurethanes, water-soluble acryls, water-soluble polyesters and water-soluble polyamides.

There is no particular limitation in the coating method to be used when the aqueous emulsion thus prepared is coated on the above peel layer to provide at least one layer, and there can be employed a known method, for example, a method in which a wire bar or the like is used.

The coating thickness of the aqueous solution may be set so that this heat-softening layer may have a dry thickness usually in the range of from 0.6 to 5.0 μm. Particularly preferred is to coat it so that the dry thickness may be in the range of from 1.0 to 4.0 μm.

This heat-softening layer may also preferably have a viscosity in the range of from 400 to 8,000 cps at 100° C., and it is desirable to so select the kinds, mixing amount, etc. of the hot-melting material and thermoplastic resin to be used that the viscosity may fall in this range.

For example, by carrying out the water base coating with use of the aqueous emulsion, the particles of the components for constituting the aqueous emulsion may form this heat-softening layer in such a state that the state of particles is retained to a certain degree, whereby the print quality on the transferring medium having a poor surface smoothness can be improved. In addition, unlike the case when coated according to the organic solvent process or hot-melt coating, it may not occur that the components of peel layer are eluted or softened at the time of the coating and also that the heat-softening layer is mingled with the peel layer, so that the boundary between the both constitutes a clear discontinuous layer. Accordingly, the properties of the respective layers can not be impaired. Since also there is contained substantially no organic solvent, the "sticking" on the surface of the heat-softening layer may not be caused.

As described above, as an embodiment of this invention, this heat-softening layer may preferably be formed by the so-called water base coating in which the coating is carried out with use of the aqueous emulsion of the constituent components. In this occasion, however, at least the respective parts of the thermoplastic resin and hot-melting material which form this layer are previously mixed substantially in the absence of water to make a homogeneous mixture and then this mixture is dispersed in water to make an aqueous emulsion. The aqueous emulsion thus obtained and an aqueous emulsion of the remaining components which form this layer are mixed, and coated on the above peel layer to form the heat-softening layer.

It is unnecessary for the hot-melting material and thermoplastic resin previously mixed in the absence of water to be mixed in their whole amount with the parts of them used in this layer. In this invention, however, it is preferable to previously mix them in an amount of 20% by weight or more (preferably 30% by weight or more) of the weight of those used in this layer. It is also unnecessary to determine the mixing proportion of the hot-melting material and thermoplastic resin in correspondence to the mixing proportion of the both which form this layer. In this invention, it is preferable to prepare a mixture containing the thermoplastic resin in the range of 5 to 50% by weight based on the total amount of this mixture, and the balance comprised of the hot-melting material and a surface active agent, and it is particularly preferable to prepare a mixture containing the thermoplastic resin in the range of 10 to 40% by weight. It is desirable to further add the surface active agent for the purpose of promoting the homogeneous mixing between the hot-melting material and thermoplastic resin. In this occasion, the surface active agent may preferably be used in the mixing proportion of 20% by weight based on the total weight of the hot-melting material, thermoplastic resin and surface active agent.

Here, as the surface active agent, there can be used any of nonionic surface active agents, anionic surface active agents, cationic surface active agents and amphoteric surface active agents.

The mixing of these components is carried out substantially in the absence of water. Herein, what is meant by "substantially" is to carry out the mixing without positively adding water at the time of the mixing, and therefore it is not of the sense that there is excluded even the water content the components such as the thermoplastic resin, hot-melting material and surface active agent may have in an ordinary state.

The mixing can also be carried out by employing a method in which the components such as the thermoplastic resin and hot-melting material are forcedly stirred as they are. In this invention, however, it is possible to desirably use a method in which the components are mixed with stirring while heating to such a degree that the hot-melting material is melted. The heating in this instance is carried out usually at a temperature of 150° C. or less (preferably 120° C. or less). In this invention, when the thermoplastic resin, the hot-melting material and the surface active agent are mixed, it is also possible to control the viscosity by using an organic solvent. The organic solvent in this instance is added usually in the proportion of 20% by weight or less based on the total weight of the thermoplastic resin and hot-melting material to be mixed.

Subsequently, water is added in the mixture thus obtained to prepare the aqueous emulsion.

The amount of the water to be added may be in the range used for preparing aqueous emulsions generally available, and, particularly in this invention, preferred is to add water so that the amount of the effective components in the aqueous emulsion may fall in the range of from 5 to 50% by weight.

The aqueous emulsion thus obtained can be coated as it is, on the above peel layer to form the heat-softening layer. It may preferably be further mixed with an aqueous emulsion of the thermoplastic resin or an aqueous emulsion of the hot-melting material that has been separately prepared, and coated on the above peel layer after so controlling the content of the respective components that it may fall in the range desirable for forming the heat-softening layer. Also, as the aqueous emulsion of the thermoplastic resin or hot-melting material, used in this instance, there can be used emulsions prepared by a conventional method.

Protective layer

As an embodiment of this invention, the thermal transfer recording medium may be provided with at least one protective layer laminated on the above coloring material layer for the purpose of imparting a correction performance.

This protective layer chiefly functions as a layer for adhering the coloring material layer (usually, a greater part of the coloring material is contained in this layer) on the surface of the transferring medium, and at the same time has the action of preventing the coloring material layer from directly permeating into the transferring medium.

Accordingly, when the correction of an ink layer transferred (for example, the coloring material layer) is made with use of an adhesive tape, an interfacial peeling usually takes place between the protective layer and coloring material layer on the surface of the transferring medium to remove the transferred part, and thus the correction can be performed. In this occasion, the coloring material, which does not permeate into a deep part of the transferring medium by the action of the protective layer, can be readily removed by the correction, so that no coloring material may remain on the transferring medium and a part of the protective layer which is substantially colorless may only remain thereon according to circumstances.

This protective layer chiefly comprised of a hot-melting material and a thermoplastic resin, and this protective layer is substantially colorless, therefore substantially containing no coloring material.

There usually is no particular limitation in the content of each of the hot-melting material and the thermoplastic resin, but they may preferably be contained, respectively, in an amount of about 3 to 97% by weight based on the total weight of the hot-melting material and thermoplastic resin, and particularly preferably 50% by weight or more for the hot-melting material. The hot-melting material content of less than 50% may result in an overly great cohesive force of the protective layer to lower the permeability to the transferring medium, and particularly sometimes resulting in no sufficient improvement in the transfer performance on the rough paper.

Also, in this layer, the hot-melting material and the thermoplastic resin are contained in total in the proportion of 90% by weight or more based on the total components contained in this layer.

This protective layer can well be coated by employing the organic solvent process and the hot-melt coating, but, in this invention, it is more preferable to employ a method in which an aqueous emulsion containing the hot-melting material and thermoplastic resin is prepared to carry out the water base coating by use of this aqueous emulsion.

In instances in which this water base coating is required, the hot-melting material and the thermoplastic resin used when the above coloring material layer is prepared can be used as they are, and, as for the aqueous emulsion, the respective aqueous emulsions can also be used as they are.

In instances in which the water base coating is employed, there may desirably be further contained a fluorine type surface active agent in addition to the surface active agent used when an aqueous emulsion of the thermoplastic resin and that of the hot-melting material are prepared The incorporation of the fluorine type surface active agent can prevent the blocking phenomenon in the ink layer.

The amount for the addition of this fluorine type surface active agent is same as in the case of the coloring material layer.

This protective layer may have a film thickness usually of from 0.1 to 5.0 μm, particularly preferably from 0.5 to 4.0 μm.

With regard also to the method of coating the aqueous emulsion, the coating can be carried out in the same manner as in the case of the above coloring material layer.

In the above, the description has been made chiefly on the instances the water base coating is carried out, but the coloring material layer and protective layer in the thermal transfer recording medium of this invention can also be laminated by the hot-melt coating or the organic solvent process as supplementarily described everywhere. In the coating method in this instance, there can be utilized conventional methods. For example, in the coating method using an organic solvent, there can be used as the solvent, aromatic organic solvents such as toluene and xylene or organic solvents containing a polar group, such as methyl ethyl ketone and cyclohexane.

There is no particular limitation in the plane shape of the thermal transfer recording medium thus obtained, which, in general, is used in the shape of a typewriter ribbon or a wide tape used in line printers. It is also possible to make a thermal transfer recording medium in which the peel layer or coloring material layer incorporated with coloring materials having some kinds of color tones for the purpose of color recording is coated in a fashion divided in stripes or brocks.

The thermal transfer process using this thermal transfer recording medium has no difference from conventional thermal transfer process, but, by way of caution, here will be described an instance in which a most typical thermal head is used as a heat source.

That is to say, the thermal transfer recording medium is brought into close contact with the transferring medium, for example, a sheet of transferring paper, and, while a heat pulse is applied if necessary from the back face of the transferring paper by means of a platen, a heat pulse is applied by means of a thermal head to locally heat the peel layer and coloring material layer according to a desired print or transfer pattern. The heated portions of the peel layer and coloring material layer increase in temperature and the peel layer and coloring material layer are immediately softened, so that the softened coloring material layer is transferred on the transferring medium.

Also, the transferred part can be corrected by bringing the part to be corrected into adhesion to a correction tape, with use of a usual correction tape or the like.

Performing the transfer by use of the thermal transfer recording medium obtained by the preparation process of this invention, at least one peel layer provided by coating on the support and at least one heat-softening layer provided by coating thereon may act cooperatively, whereby print can be formed in a high quality not only of course on transferring paper having a high surface smoothness but also on transferring paper having a poor surface smoothness. Moreover, the thermal transfer recording medium obtained by the preparation process of this invention may cause less blocking.

In another embodiment of this invention, at least one peel layer and at least one heat-softening layer are formed on the support, wherein the coloring material is contained in at least one layer of these and at the same time the polyoxyethylene compound is contained in the peel layer adjacent to the support. Accordingly, the fixing performance of a thermal transfer layer on the transferring medium can be improved, and thus print can also be formed in a high quality not only of course on the transferring medium having a high surface smoothness but also on the transferring medium having a poor surface smoothness.

In a further embodiment of this invention, the thermal transfer recording medium contains the ionomer in the heat-softening layer in such a state that no continuous layer is formed together with the components which form this layer. Accordingly, the transfer can be performed in a good print quality even on the transferring medium such as rough paper having a poor surface smoothness. At the same time, because of formation of no continuous layer, the good stretchability attributable to the ionomer is intermittently exhibited for each of the constituent units taking the form, for example, of particles or the like (besides this, including the form of mica, plates or the like that may not form any continuous layer), so that there may be caused less tailing, stringing phenomenon or the like, resulting in improvement in print quality.

The water base coating of the heat-softening layer containing the ionomer can further bring about the effect excellent in the aspects of preparation equipment cost, work environment excellency, safety, and production cost.

Also, in an embodiment of this invention, at least one layer for each of the peel layer and the heat-softening layer is formed on the support, and at least one heat-softening layer among these is controlled to have a breaking extension at 27° C. of not less than 70% and not more than 200%. Accordingly, because of a decrease in the void volume, the heat sensitive transfer layer can move to the transferring paper with a uniform thickness, and at the same time the fixing performance of the thermal transfer layer on the transferring paper can be improved.

Still also, in an embodiment of this invention, the thermal transfer recording medium comprises at least one peel layer provided on the support, at least one coloring material layer laminated thereon, and at least one substantially colorless protective layer further laminated thereon. Accordingly, these layers may mutually act to make it possible to perform the transfer in a high print quality not only of course on the transfer paper having a high surface smoothness but also on the transfer paper having a poor surface smoothness.

Moreover, the thermal transfer recording medium according to this invention makes it possible to carry out a stable transfer that causes less blocking. There also may be caused less scumming at the time of the transfer.

In addition, chiefly by virtue of the action of the protective layer, the coloring material in the layer transferred on the transferring medium is not in the state that it has permeated into a deep part of the transferring medium. Accordingly, the correction can be made without leaving any marks of coloring material.

The thermal transfer recording medium of this invention can have very good properties by forming at least one layer of the coloring material layer and the protective layer by the water base coating.

The employment of the water base coating can further bring about the advantage that a work environment may suffer less pollution.

Moreover, in the thermal transfer recording medium obtained by the preparation process of this invention, the heat-softening layer is formed by using the aqueous emulsion, so that the boundary between the peel layer and heat-softening layer forms a clear discontinuous layer. Accordingly, the properties possessed by the peel layer and heat-softening layer may not be impaired. In addition, in the heat-softening layer thus formed, the components which form this layer are present in a state of very small particles (even though the form thereof may vary to mica, plates, ovals or the like), and, as for these particles, when viewed microscopically, each of these particles is independently brought into a softened state at the time of the transfer. Accordingly, it has a good transfer performance even on the transferring medium such as rough paper having a poor surface smoothness.

EXAMPLES

Examples of this invention will be given below, but this invention is by no means limited by these. Also, "part(s)" herein used refers to "part(s) by weight".

EXAMPLE 1

On a polyethylene terephthalate film of 3.5 μm thick, a peel layer was formed by hot-melt coating of a peel layer coating composition shown below, to have a film thickness of 1.8 μm.

| Peel layer coating composition | |
|---|---|
| Paraffin wax (m.p.: 70° C.) | 95 parts |
| Ethylene/vinyl acetate copolymer | 5 parts |

Next, a heat-softening layer was formed by water base coating of a heat-softening layer coating composition shown below on the peel layer with use of a wire bar to have a film thickness of 2.0 μm, to prepare a thermal transfer recording medium.

| Heat-softening layer coating composition | |
|---|---|
| Aqueous acrylic emulsion ["Boncoat 3226"] | 50 parts |
| Aqueous paraffin wax emulsion [an emulsion obtained by emulsifying paraffin wax melting at 70° C., in water] | 25 parts |
| Aqueous carnauba wax emulsion | 10 parts |
| Carbon black dispersion in water | 25 parts |
| Fluorine type surface active agent ["FT-248"; available from Bayer AG] | 0.5 parts |

(The expression "... parts" in the above emulsions is in terms of the calculated weight of the effective components in the emulsions. In this invention, the same applies to the following.)

Using the resulting thermal transfer recording medium, recording (printing) was performed on a sheet of rough paper (Spica bond paper; Beck's smoothness: 10 seconds) at a printing speed of 40 cps with use of a thermal printer A (a 24 dot serial head; platen pressure: 250 g/head; platen rubber hardness: 70° C.), to evaluate the print quality.

Similarly, recording (printing) was performed on a sheet of rough paper (Rankuster bond paper; Beck's smoothness: 2 seconds) at a printing speed of 40 cps with use of a thermal printer B (a 24 dot serial head; platen pressure: 400 g/head; platen rubber hardness: 80° C.), to evaluate the print quality.

In any instances, there was obtained very sharp print (alphabets) free from blur, feathering and scumming.

In respect also of this thermal transfer recording medium, the blocking-occurring temperature under a load of 80 g/cm$^2$ according to a temperature gradient method was found to be 63° C.

EXAMPLE 2

A thermal transfer recording medium was prepared in the same manner except that a coating composition shown below was used in place of the heat-softening layer coating composition in Example 1.

| Heat-softening layer coating composition | |
|---|---|
| Aqueous ethylene/vinyl acetate emulsion | 50 parts |
| Paraffin wax emulsion [an emulsion obtained by emulsifying paraffin wax melting at 70° C., in water] | 25 parts |
| Carbon black dispersion in water | 25 parts |
| Fluorine type surface active agent ["FT-248"; available from Bayer AG] | 0.5 part |

In respect of the resulting thermal transfer recording medium, the print quality was evaluated in the same manner as in Example 1. As a result, in any instances, there was obtained sharp print (alphabets) free from blur, feathering and scumming.

In respect also of this thermal transfer recording medium, the blocking-occurring temperature under a load of 80 g/cm$^2$ according to a temperature gradient method was found to be 60° C.

COMPARATIVE EXAMPLE 1

A thermal transfer recording medium was prepared in the same manner except that, in place of the coating composition for the heat-softening layer in Example 1, a coating solution prepared by dispersing with heating, a heat-softening layer coating composition shown below in 300 parts of toluene with use of a ball mill, followed by cooling, was coated with use of a wire bar.

| Heat-softening layer coating composition | |
|---|---|
| Ethylene/vinyl acetate copolymer | 50 parts |
| Paraffin wax [m.p.: 70° C.] | 25 parts |
| Carbon black | 25 parts |

In respect of the resulting thermal transfer recording medium, the print quality was evaluated in the same manner as in Example 1. As a result, in any instances, there was obtained no sharp print (alphabets), causing blur, feathering and scumming.

Also, the blocking-occurring temperature under a load of 80 g/cm$^2$ according to a temperature gradient method was found to be 53° C.

COMPARATIVE EXAMPLE 2

A thermal transfer recording medium was prepared in the same manner except that a coating composition shown below was used in place of the coating composition in comparative Example 1.

| Heat-softening layer coating composition | |
|---|---|
| Ethylene/acrylate copolymer | 50 parts |
| Paraffin wax [m.p.: 70° C.] | 25 parts |
| Carbon black | 25 parts |
| Carnauba wax | 10 parts |

In respect of the resulting thermal transfer recording medium, the print quality was evaluated in the same manner as in Example 1. As a result, in any instances, there was obtained no sharp print (alphabets), causing blur, feathering and scumming.

Also, the blocking-occurring temperature under a load of 80 g/cm$^2$ according to a temperature gradient method was found to be 54° C.

EXAMPLE 3

On a polyethylene terephthalate film of 3.5 μm thick, a peel layer of this invention was formed by hot-melt coating of a coating composition shown below, to have a film thickness of 2.0 μm.

| | |
|---|---|
| Paraffin wax (m.p.: 70° C.) | 65 parts |
| Ethylene/vinyl acetate copolymer | 5 parts |
| Polyoxyethylene (n = 5) monobehenyl ether | 40 parts |

Next, a heat-softening layer was formed by water base coating of a coating composition shown below on the peel layer with use of a wire bar to have a film thickness of 2.0 μm, to obtain a sample of the thermal transfer recording medium of this invention.

| | |
|---|---|
| Aqueous emulsion of ethylene/vinyl acetate copolymer | 35 parts |
| Paraffin wax (an emulsion obtained by emulsifying paraffin wax melting at 70° C., in water; m.p.: 70° C.) | 30 parts |
| Aqueous acrylic emulsion | 10 parts |
| Carbon black | 25 parts |

(The expression "... parts" in the above emulsions is in terms of the calculated weight of the effective components in the emulsions. In this invention, the same applies to the following.)

Using the sample of the thermal transfer recording medium, recording (printing) was performed on a sheet of rough paper (Spica bond paper; Beck's smoothness: 10 seconds) at a printing speed as shown in Table 1 with use of a thermal printer (a 24 dot serial head; platen pressure 320 g/head; applied energy: 35 mJ/head), to evaluate the print quality in each printing speed. As a result, no print omission was seen in any printing speed, and there was obtained sharp print free from blur, feathering and scumming.

Results are shown in Table 1.

At the printing speed of 20 letters per second, clear print was obtained even when the applied energy was 25 mJ/head, and the thermal transfer layer showed a good sensitivity.

A peel test was further carried out with use of an adhesive tape in respect of the thermal transfer layer transferred on the rough paper at a printing speed of 40 letters per second. As a result, there was seen no peeling of the thermal transfer layer from the rough paper, showing a good fixing performance of the thermal transfer layer to the rough paper.

EXAMPLE 4

Using a sample of a thermal transfer recording medium obtained by coating in the same manner as in Example 3 a coating composition in which polyoxyethylene (n=50) distearyl ester was used in place of the polyoxyethylene (n=5) monobehenyl ether of the peel layer in Example 1, the print quality in each printing speed was evaluated in the same manner as in Example 1.

Similar to Example 3, no print omission was seen in any printing speed also in the present Example, and there was obtained sharp print free from blur, feathering and scumming.

Results are shown in Table 1.

The sensitivity and the fixing performance were also evaluated in the same manner as in Example 3 to obtain good results for both of the sensitivity and fixing performance.

COMPARATIVE EXAMPLE 3

Using a sample of a thermal transfer recording medium obtained by coating in the same manner as in Example 1 a coating composition in which paraffin wax was used in place of the polyoxyethylene (n=5) monobehenyl ether of the peel layer in Example 3, the print quality in each printing speed was evaluated in the same manner as in Example 3. As a result, the print omission increased with increase in the printing speed, and print was hardly made at a printing speed of 50 letters per second.

There also occurred blur, feathering and scumming with increase in the printing speed.

Results are shown in Table 1.

COMPARATIVE EXAMPLE 4

Using a sample of a thermal transfer recording medium obtained by coating in the same manner as in Example 3 a coating composition in which carnauba wax was used in place of the polyoxyethylene (n=5) monobehenyl ether of the peel layer in Example 3, the print quality in each printing speed was evaluated in the same manner as in Example 3. As a result, the print omission increased with increase in the printing speed, and print was hardly made at a printing speed of 50 letters per second.

There also occurred blur, feathering and scumming with increase in the printing speed.

Results are shown in Table 1.

EXAMPLE 5

In place of the heat-softening layer in Example 3, a coating composition shown below was dispersed with heating in 300 parts of toluene and, after cooling, was coated on the peel layer with use of a wire bar to have a film thickness of 1.8 μm, to obtain a sample of the thermal transfer recording medium of this invention.

| | |
|---|---|
| Ethylene/vinyl acetate copolymer | 35 parts |
| Ethylene ethyl acrylate | 8 parts |
| Paraffin wax [m.p.: 70° C.] | 22 parts |
| Carnauba wax | 20 parts |
| Carbon black | 15 parts |

Using the resulting sample of the thermal transfer recording medium, the print quality in each printing speed was evaluated in the same manner as in Example 3.

In the present Example, although the print omission was slightly seen at a printing speed of 50 letters per second, there was obtained sharp print free from blur, feathering and scumming at other printing speed.

Results are shown in Table 1.

The sensitivity and the fixing performance were also evaluated in the same manner as in Example 3 to obtain good results for both of the sensitivity and fixing performance.

The print quality was visually evaluated based on the following three ranks.

A . . . Alphabets are reproduced in sharpness.

B . . . Alphabets are reproduced in slight unsharpness.

C . . . Alphabets are reproduced in unsharpness.

TABLE 1

| | Printing speed (cps)* | | | |
|---|---|---|---|---|
| | 20 | 30 | 40 | 50 |
| Example 3 | A | A | A | A |
| Example 4 | A | A | A | A |
| Comp. Exa. 3 | A | B | C | C |
| Comp. Exa. 4 | A | B | C | C |
| Example 5 | A | A | A | B |

*cps: Print number per second

EXAMPLE 6

On a polyethylene terephthalate film of 3.5 μm thick, a peel layer of this invention was formed by hot-melt coating of a coating composition shown below, to have a film thickness of 1.8 μm.

| | |
|---|---|
| Paraffin wax (m.p.: 70° C.) | 80 parts |
| Ethylene/vinyl acetate copolymer | 10 parts |
| Carnauba wax | 10 parts |

Next, a heat-softening layer of this invention was formed by water base coating of a coating composition shown below on the peel layer with use of a wire bar to have a film thickness of 1.9 μμm, to obtain a sample of the thermal transfer recording medium of this invention.

| | |
|---|---|
| Aqueous paraffin emulsion (an emulsion obtained by emulsifying paraffin wax melting at 70° C., in water) | 15 parts |
| Aqueous ethylene/vinyl acetate ionomer emulsion [trade name: "Chemipearl S-100", available from Mitsui Petrochemical Industries, Ltd.] | 20 parts |
| Aqueous acrylic emulsion | 30 parts |
| Carbon black dispersion in water | 25 parts |
| Aqueous rosin emulsion | 10 parts |

(The expression " . . . parts " in the above emulsions is in terms of the calculated weight of the effective components in the emulsion. In this invention, the same applies to the following.)

Using the sample of the thermal transfer recording medium, recording (printing) was performed on a sheet of rough paper (Fox River bond paper; Beck's smoothness: 3 seconds) at a printing speed of 30 letters per second with use of a thermal printer (a 24 dot serial head; platen pressure: 280 g/head; applied energy: 35 mJ/head), to evaluate the print quality. As a result, there was obtained sharp print free from blur, feathering and scumming.

Results are shown in Table 2.

COMPARATIVE EXAMPLE 5

Using a sample of a thermal transfer recording medium obtained by coating in the same manner as in Example 6 a coating composition in which an ethylene/vinyl acetate copolymer was used in place of the aqueous ethylene/vinyl acetate ionomer emulsion of the heat-softening layer in Example 6, the print quality was evaluated in the same manner as in Example 6. As a result, there seriously occurred blur, feathering and scumming to obtain no sharp print.

Results are shown in Table 2.

COMPARATIVE EXAMPLE 6

Using a sample of a thermal transfer recording medium obtained by coating in the same manner as in Example 1 a coating composition in which paraffin wax was used in place of the aqueous ethylene/vinyl acetate ionomer emulsion of the heat-softening layer in Example 6, the print quality was evaluated in the same manner as in Example 6. As a result, there seriously occurred blur feathering and scumming to obtain no sharp print.

Results are shown in Table 2.

EXAMPLE 7

Example 6 was repeated to obtain a peel layer of this invention, except that a coating composition shown below was used in place of the coating composition for the peel layer.

| | |
|---|---|
| Paraffin wax (m.p.: 70° C.) | 82 parts |
| Ethylene/vinyl acetate copolymer | 8 parts |
| Carbon black | 10 parts |

Next, a coating composition shown below was dispersed with heating in 300 parts of toluene and, after cooling, coated by water base coating on the peel layer in the same manner as in Example 6, to form a first heat-softening layer.

| | |
|---|---|
| Paraffin wax (m.p.: 70° C.) | 50 parts |
| Ethylene/vinyl acetate copolymer | 40 parts |
| Carbon black | 10 parts |

A second heat-softening layer was further formed by water base coating of a coating composition shown below on the first heat-softening layer with use of a wire bar to have a film thickness of 1.8 μm, to obtain a sample of the thermal transfer recording medium of this invention.

| | |
|---|---|
| Aqueous paraffin emulsion (an emulsion obtained by emulsifying paraffin wax melting at 70° C., in water) | 20 parts |
| Aqueous acrylic emulsion | 60 parts |
| Aqueous ethylene/vinyl acetate ionomer emulsion [trade name: "Chemipearl S-100", available from Mitsui Petrochemical Industries, Ltd.] | 20 parts |
| Fluorine type surface active agent [trade name: "Megafac F-120] | 0.5 part |

Using the resulting sample of the thermal transfer recording medium, the print quality was evaluated in the same manner as in Example 6. As a result, there was obtained sharp print free from blur, feathering and scumming.

Results are shown in Table 2.

COMPARATIVE EXAMPLE 7

Using a sample of a thermal transfer recording medium obtained by coating in the same manner as in Example 7 a coating composition in which an aqueous acrylic emulsion was used in place of the aqueous ethylene/vinyl acetate ionomer emulsion of the second heat-softening layer in Example 7, the print quality was evaluated in the same manner as in Example 7. As a result, there occurred blur, feathering and scumming to obtain somewhat unsharp print.

Results are shown in Table 2.

COMPARATIVE EXAMPLE 8

Using a sample of a thermal transfer recording medium obtained by coating in the same manner as in Example 7 a coating composition in which an aqueous paraffin emulsion was used in place of the aqueous ethylene/vinyl acetate ionomer emulsion of the second heat-softening layer in Example 7, the print quality was evaluated in the same manner as in Example 7. As a result, there occurred blur, feathering and scumming to obtain somewhat unsharp print.

Results are shown in Table 2.

The print quality was evaluated by visual observation based on the following three ranks.

A . . . Alphabets are reproduced in sharpness.

B . . . Alphabets are reproduced in slight unsharpness.

C . . . Alphabets are reproduced in unsharpness.

TABLE 2

| | Print quality |
|---|---|
| Example 6 | A |
| Comparative example 5 | C |
| Comparative example 6 | C |
| Example 6 | A |
| Comparative example 7 | B |
| Comparative example 8 | B |

COMPARATIVE EXAMPLE 9

On a polyethylene terephthalate film of 3.5 μm thick, a peel layer was formed by hot-melt coating of a peel layer coating composition shown below, to have a film thickness of 2.0 μm.

| Peel layer coating composition | |
|---|---|
| Paraffin wax | 90 parts |
| Ethylene/vinyl acetate copolymer | 10 parts |

Next, a heat-softening layer was formed by water base coating of a heat-softening layer coating composition shown below on the peel layer with use of a wire bar to have a film thickness of 2 μm, to obtain a thermal transfer recording medium.

| Heat-softening layer coating composition | |
|---|---|
| Aqueous acrylic emulsion | 75 parts |
| Carbon black dispersion in water | 25 parts |

(The expression " . . . parts" in the above emulsions is in terms of the calculated weight of the effective components in the emulsion. In this invention, the same applies to the following.)

Measured was the relationship between the temperature and breaking extension of the heat-softening layer of this thermal transfer recording medium. The breaking extension of the heat-softening layer at 27° C. was found to be 240%.

In this invention, the measurement of the breaking extension was carried out in the following manner.

| | |
|---|---|
| Measuring equipment: | Fudo Rheometer (manufactured by Fudo Kogyo K.K.) |
| Measured sample: | 20 mm width and 0.2 to 20 mm long |
| Grab space: | 20 cm |
| Rate of pulling: | 100 mm/min. |
| Measurement temperature and humidity | 27° C., 50% |

Subsequently, using the resulting sample of the thermal transfer recording medium, recording (printing) was performed on a sheet of rough paper (Rankuster bond paper; Beck's smoothness: 2 seconds) at a printing speed of 20 letters per second with use of a thermal printer (a 24 dot serial head; platen pressure: 250 g/head; applied energy: 30 mJ/head), to evaluate the print quality. As a result, although there occurred no blur, feathering and scumming, there was obtained print accompanied with stringiness and lacking in edge sharpness.

EXAMPLE 8

A thermal transfer recording medium was prepared in the same manner except that a heat-softening layer coating composition shown below was used in place of the heat-softening layer coating composition used in Comparative Example 9.

| Heat-softening layer coating composition | |
|---|---|
| Aqueous acrylic emulsion | 35 parts |
| Aqueous rosin emulsion | 30 parts |
| Aqueous paraffin emulsion (an emulsion obtained by emulsifying paraffin wax melting at 70° C., in water) | 10 parts |
| Carbon black dispersion in water | 25 parts |

On this thermal transfer recording medium, measured was the relationship between the temperature and breaking extension in the same manner as in Comparative Example 9. As a result, the breaking extension of the heat-softening layer at 27° C. was found to be 180%.

Next, using the resulting thermal transfer recording medium, the print quality was evaluated in the same manner as in Example 8. As a result, there was obtained sharp print suffering less blur, feathering and scumming.

EXAMPLE 9

A thermal transfer recording medium was prepared in the same manner except that a heat-softening layer coating composition shown below was used in place of the heat-softening layer coating composition used in Comparative Example 9.

| Heat-softening layer coating composition | |
|---|---|
| Aqueous emulsion of ethylene/vinyl acetate copolymer | 25 parts |
| Aqueous acrylic emulsion | 20 parts |
| Aqueous paraffin emulsion (an emulsion obtained by emulsifying paraffin wax melting at 70° C., in water) | 30 parts |
| Carbon black dispersion in water | 25 parts |

On this thermal transfer recording medium, measured was the relationship between the temperature and breaking extension in the same manner as in Comparative Example 9. As a result, the breaking extension of the heat-softening layer at 27° C. was found to be 75%.

Next, using the resulting thermal transfer recording medium, the print quality was evaluated in the same manner as in Example 8. As a result, there was obtained sharp print suffering less blur, feathering and scumming.

COMPARATIVE EXAMPLE 10

A thermal transfer recording medium was prepared in the same manner except that a heat-softening layer coating composition shown below was used in place of the heat-softening layer coating composition used in Comparative Example 9.

| Heat-softening layer coating composition | |
|---|---|
| Aqueous acrylic emulsion [trade name: | 25 parts |

-continued

| Heat-softening layer coating composition | |
|---|---|
| "Boncoat 3226"] | |
| Aqueous rosin emulsion | 10 parts |
| Aqueous paraffin emulsion (an emulsion obtained by emulsifying paraffin wax melting at 70° C., in water) | 40 parts |
| Carbon black dispersion in water | 25 parts |

On this thermal transfer recording medium, measured was the relationship between the temperature and breaking extension in the same manner as in Comparative Example 9. As a result, the breaking extension of the heat-softening layer at 27° C. was found to be 44%.

Next, using the resulting thermal transfer recording medium, the print quality was evaluated in the same manner as in Example 8. As a result, there occurred blur, feathering and scumming to obtain no sharp print.

EXAMPLE 10

A thermal transfer recording medium was prepared in the same manner except that a heat-softening layer coating composition shown below was used in place of the heat-softening layer coating composition used in Comparative Example 9.

| Heat-softening layer coating composition | |
|---|---|
| Aqueous acrylic emulsion | 15 parts |
| Water-soluble polyester resin | 15 parts |
| Aqueous acrylic emulsion | 20 parts |
| Aqueous carnauba wax emulsion | 10 parts |
| Aqueous terpene resin emulsion | 25 parts |
| Carbon black dispersion in water | 25 parts |

On this thermal transfer recording medium, measured was the relationship between the temperature and breaking extension in the same manner as in Comparative Example 9. As a result, the breaking extension of the heat-softening layer at 27° C. was found to be 110%.

Next, using the resulting thermal transfer recording medium, the print quality was evaluated in the same manner as in Example 8. As a result, there was obtained sharp print suffering less blur, feathering and scumming.

As in the above, good printing can be performed when the breaking extension of the heat-softening layer at 27° C. falls in the range of 700 to 200%.

As for the cohesive force at 20° C., the heat-softening layer of Comparative Example 9 showed a maximum value which is 180 kg/cm$^2$; the heat-softening layer of Example 8 showed a cohesive force of 100 kg/cm$^2$; and the heat-softening layer of Example 9, a cohesive force of 80 kg/cm$^2$. It is clear from this result that the printing performance on the transferring medium having a poor surface smoothness is more affected by the breaking extension, than by the cohesive force, of the heat-softening layer.

In addition, according to a simulation from infrared microscopic data possessed by the present inventors, the heat-softening layer is peeled at a temperature of a little less than 30° C. (precisely, at 27° C. in usual cases) under the printing conditions of thermal transfer printers that are nowadays most widely used, and this correlates with the fact that the breaking extension of the heat-softening layer at 27° C. gives an important influence to the print quality.

In other words, in order to make printing without causing no void on the rough paper, very important is the physical properties at the time the heat-softening layer leaves from the support. Especially when a thermal transfer printer is used, the heat-softening layer that has been heated and brought into a softened state owing to its principle leaves from the peel layer before it is cooled to room temperature. It is therefore understood that a most important factor is the breaking extension of the heat-softening layer at the temperature existing when the layer is peeled.

EXAMPLE 11

On a polyethylene terephthalate film of 3.5 um thick, a peel layer of the thermal transfer recording medium of this invention was formed by hot-melt coating of a peel layer coating composition shown below, to have a film thickness of 1.5 μm.

| Peel layer coating composition | |
|---|---|
| Paraffin wax (m.p.: 70° C.) | 90 parts |
| Ethylene/vinyl acetate copolymer | 10 parts |

Next, a coloring material layer was formed by water base coating of a coloring material layer coating composition shown below on the peel layer with use of a wire bar to have a film thickness of 2.0 μm.

| Coloring material layer coating composition | |
|---|---|
| Aqueous paraffin wax emulsion (melting point of paraffin wax: 70° C.) | 35 parts |
| Aqueous ethylene/vinyl acetate copolymer emulsion | 35 parts |
| Carbon black | 25 parts |
| Fluorine type surface active agent [trade name: "Megafac F-120"] | 0.25 parts |

(The expression "... parts" in the above emulsions is in terms of the calculated weight of the effective components in the emulsions. In this invention, the same applies to the following.)

The above composition was controlled so that the content of the layer-forming components may be 27% by weight, followed by addition of isopropanol in an amount of 1% by weight of the total weight of the composition.

A protective layer was further formed by water base coating of a protective layer coating composition shown below on the coloring material layer with use of a wire bar to have a film thickness of 1.0 μm, to obtain a thermal transfer recording medium of this invention.

| Protective layer coating composition | |
|---|---|
| Aqueous paraffin wax emulsion (same as the above) | 40 parts |
| Aqueous ethylene/vinyl acetate copolymer emulsion (same as the above) | 60 parts |
| Fluorine type surface active agent (same as the above) | 0.5 parts |

The above composition was controlled so that the content of the layer-forming components may be 27% by weight, followed by addition of isopropanol in an amount of 1% by weight of the total weight of the composition.

Using the thermal transfer recording medium, recording (printing) was performed on a sheet of rough paper (Spica bond paper; Beck's smoothness: 10 seconds) at a printing speed of 20 cps with use of a thermal printer (a 24 dot serial head; platen pressure: 350 g/head; applied energy: 35 mJ/head; platen rubber hardness: 70°), to evaluate the print quality.

The print quality was judged by visual observation of the print part.

The print part was also observed by use of an optical microscope to make judgment on the scumming.

Results are shown in Table 3.

Next, the correction of the part at which the print was formed by use of the thermal transfer recording medium obtained was made with use of a commercially available hot type correction ribbon (available from Konishiroku Photo Industry Co., Ltd.) [Condition (1)], or the correction was made with use of a non-hot type correction ribbon [Condition (2)], and the corrected part was observed with use of the above optical microscope to make judgment on uncleanness on the rough paper after the correction was made.

The blocking performance was also evaluated by examining whether there is a tough feeling when touched.

Results are shown together in Table 3.

In this invention, the print quality, scumming, blocking performance and uncleanness after correction were tested according to the method described above.

COMPARATIVE EXAMPLE 11

Example 11 was repeated to prepare a thermal transfer recording medium, except that the protective layer was not provided.

Results of the tests on the print quality, scumming, blocking performance and uncleanness after correction are shown in Table 3.

COMPARATIVE EXAMPLE 12

Example 11 was repeated to prepare a thermal transfer recording medium, except that the protective layer was not provided and the coloring material layer was made to have a layer thickness of 2.6 μm.

Results of the tests on the print quality, scumming, blocking performance and uncleanness after correction are shown in Table 3.

EXAMPLE 12

A peel layer was formed on the support used in Example 11, by hot-melt coating of a peel layer coating composition with use of a gravure coater to have a film thickness of 1.5 μm.

| Peel layer coating composition | |
|---|---|
| Carbon black | 15 parts |
| Paraffin wax (m.p.: 70° C.) | 80 parts |
| Ethylene/ethyl acrylate copolymer (MI: 20 g/10 min.; Co: 20) | 5 parts |

Next, a coloring material coating solution shown below was prepared with use of a ball mill and, after cooling, the resulting coating solution was coated on the peel layer with use of a wire bar to have a film thickness of 1.5 μm, to form a coloring material layer.

| Coloring material layer coating composition | |
|---|---|
| Carbon black | 20 parts |
| Paraffin wax (melting point of paraffin: 70° C.) | 40 parts |
| Ethylene/vinyl acetate copolymer | 40 parts |
| Solvent (toluene/xylene) | 400 parts |

Next, a protective layer coating solution shown below was prepared with use of a ball mill and, after cooling, the resulting coating solution was coated on the peel layer with use of a wire bar to have a film thickness of 1.0 μm, to form a protective layer, thus preparing a thermal transfer recording medium of this invention.

| Protective layer coating composition | |
|---|---|
| Paraffin wax (melting point of paraffin: 70° C.) | 95 parts |
| Ethylene/ethyl acrylate copolymer (MI: 20 g/10 min.; Co: 20) | 5 parts |
| Solvent (toluene/xylene) | 400 parts |

Results of the tests on the print quality, scumming, blocking performance and uncleanness after correction are shown in Table 3.

COMPARATIVE EXAMPLE 13

Example 12 was repeated to prepare a thermal transfer recording medium, except that 30 parts of carbon black were mixed to the protective layer.

Results of the tests on the print quality, scumming, blocking resistance and uncleanness after correction are shown in Table 3.

In Table 3, the print quality was evaluated by visual observation based on the following four ranks:

AA . . . Alphabets are reproduced in a very great sharpness, producing no void at all.

A . . . Alphabets are reproduced in sharpness, producing no void.

B . . . Alphabets are reproduced in slight unsharpness.

C . . . Alphabets are reproduced in unsharpness.

Regarding the scumming and the uncleanness after correction, these were evaluated based on three ranks as follows:

A . . . No scumming is seen. No uncleanness remains.

B . . . Scumming is seen slightly. Slightly remaining uncleanness is seen.

C . . . Scumming is seen. Uncleaness considerably remains.

Regarding also the blocking resistance, this was evaluated based on four ranks as follows:

AA . . . There is no touch feeling at all.

A . . . There is little touch feeling.

B . . . There is a tough feeling slightly.

C . . . There is a tough feeling.

TABLE 3

| | Print quality | Scumming | Uncleaness after correction Cond.(1) | Uncleaness after correction Cond.(2) | Blocking resistance |
|---|---|---|---|---|---|
| Example 11 | AA | A | A | A | AA |
| Comp.Ex. 11 | C | B | C | B | B |
| Comp.Ex. 12 | C | B | C | B | B |
| Example 12 | A *1 | A | A | A | A |
| Comp.Ex. 13 | C | C | C | C | C |

Note *1: Observation by using an optical microscope reveals that the print sometimes lacks in the edge sharpness.

As shown in Table 3, the thermal transfer recording medium shows a good print quality, causes less scumming and has a good blocking resistance. It also remains less uncleaness after the correction, having very good properties. EXAMPLE 13

On a polyethylene terephthalate film of 3.5 μm thick, a peel layer was formed by hot-melt coating of a peel layer coating composition shown below, to have a film thickness of 1.8 μm.

| Peel layer coating composition | |
|---|---|
| Paraffin wax (m.p.: 70° C.) | 60 parts |
| Carnauba wax | 20 parts |
| Ethylene/vinyl acetate copolymer | 20 parts |

Next, a mixture (A) for heat-softening layer shown below was blended with stirring under heating (heating temperature: 120° C.).

| Mixture (A) for heat-softening layer | |
|---|---|
| Paraffin wax (HNP-10; available from Nippon Seirou K.K.) | 40 parts |
| Microcrystalline wax | 10 parts |
| Ethylene/vinyl acetate copolymer | 5 parts |

Water was added to the resulting mixture (A) for heat-softening layer to prepare an emulsion, and a heat-softening layer coating composition (I) containing this was prepared. A heat-softening layer was formed by water base coating of this composition on the peel layer with use of a wire bar to have a dry film thickness of 2.0 μm, thus preparing a thermal transfer recording medium.

| Heat-softening layer coating composition (I) | |
|---|---|
| Aqueous emulsion of mixture (A) for heat-softening layer | 30 parts |
| Aqueous ethylene/vinyl acetate copolymer emulsion | 30 parts |
| Aqueous paraffin wax emulsion | 10 parts |
| Carbon black dispersion in water | 30 parts |
| Fluorine type surface active agent (FT-248; available from Bayer AG) | 0.5 part |

The expression "... parts" in the above emulsions is in terms of the calculated weight of the effective components in the emulsions. In this invention, the same applies to the following.

EXAMPLE 14

A mixture (B) for heat-softening layer described below was prepared in place of the mixture (A) for heat-softening layer in Example 13.

| Mixture (B) for heat-softening layer | |
|---|---|
| Paraffin wax (HNP-10; available from Nippon Seirou K.K.) | 30 parts |
| Ethylene/vinyl acetate copolymer | 10 parts |
| Anionic surface active agent | 3.5 parts |

Next, an aqueous emulsion of this mixture (B) for heat-softening layer was prepared and a heat-softening layer coating composition (II) containing this was prepared, to prepare a thermal transfer recording medium in the same manner except for use of this composition.

| Heat-softening layer coating composition (II) | |
|---|---|
| Aqueous emulsion of mixture (B) for heat-softening layer | 40 parts |
| Aqueous acrylic resin emulsion | 25 parts |
| Aqueous rosin type resin emulsion | 10 parts |
| Carbon black dispersion in water | 25 parts |
| Fluorine type surface active agent (FT-248; available from Bayer AG) | 0.5 part |

COMPARATIVE EXAMPLE 14

Example 13 was repeated to prepare a thermal transfer recording medium, except that a heat-softening layer coating composition (III) described below was used in place of the heat-softening layer coating composition (I).

| Heat-softening layer coating composition (III) | |
|---|---|
| Aqueous ethylene/vinyl acetate copolymer emulsion | 33 parts |
| Aqueous paraffin wax emulsion | 32 parts |
| Aqueous microcrystalline wax emulsion | 5 parts |
| Carbon black dispersion in water | 30 parts |
| Fluorine type surface active agent (FT-248; available from Bayer AG) | 0.5 part |

The amounts for mixing the respective components of the above heat-softening layer coating composition (III) are substantially the same as the composition of the heat-softening layer coating composition (I) in Example 1.

COMPARATIVE EXAMPLE 15

Example 13 was repeated to prepare a thermal transfer recording medium, except that a heat-softening layer coating composition (IV) described below was used in place of the heat-softening layer coating composition (I).

| Heat-softening layer coating composition (IV) | |
|---|---|
| Aqueous ethylene/vinyl acetate copolymer emulsion | 9 parts |
| Aqueous acrylic resin emulsion | 25 parts |
| Aqueous paraffin wax emulsion | 28 parts |
| Aqueous rosin type resin emulsion | 10 parts |
| Carbon black dispersion in water | 25 parts |
| Fluorine type surface active agent (FT-248; available from Bayer AG) | 0.5 part |

The amounts for mixing the respective components of the above heat-softening layer coating composition (IV) are substantially the same as the composition of the heat-softening layer coating composition (I) in Example 13.

COMPARATIVE EXAMPLE 16

Example 13 was repeated to prepare a thermal transfer recording medium, except that a heat-softening layer coating composition (V) described below was used in place of the heat-softening layer coating composition (I).

| Heat-softening layer coating composition (V) | |
|---|---|
| Aqueous ethylene/vinyl acetate copolymer emulsion | 60 parts |
| Aqueous paraffin wax emulsion | 10 parts |
| Carbon black dispersion in water | 30 parts |
| Fluorine type surface active agent (FT-248; available from Bayer AG) | 0.5 part |

COMPARATIVE EXAMPLE 17

Example 13 was repeated to prepare a thermal transfer recording medium, except that a heat-softening layer coating composition (VI) described below was used in place of the heat-softening layer coating composition (I).

| Heat-softening layer coating composition (VI) | |
|---|---|
| Aqueous acrylic resin emulsion | 25 parts |
| Aqueous paraffin wax emulsion | 40 parts |
| Aqueous rosin type resin emulsion | 10 parts |
| Carbon black dispersion in water | 25 parts |
| Fluorine type surface active agent (FT-248; available from Bayer AG) | 0.5 part |

Evaluation

Using the resulting thermal transfer recording medium, recording (printing) was performed on a sheet of rough paper (Spica bond paper; Beck's smoothness: 3 seconds) at a printing speed of 60 cps with use of a thermal printer (a 24 dot serial head; platen pressure: 180 g/head), to evaluate the state of occurrence of scumming, the fixing performance and the print quality.

The symbols in Table 4 for the respective reinforcement items represent the following meaning:

Scumming

A . . . No scumming occurred under the above printing conditions.

C . . . Scumming occurred under the same conditions.

Fixing performance

A . . . No lifting of printed letters.

C . . . Lifting of printed letters is seen.

Print quality

A . . . Print for "A" shows a good edge sharpness, and no void appears at the part of solid print.

B . . . No void appears at the part of solid print, but print for "A" shows a poor edge sharpness.

C . . . Print for "A" shows a poor edge sharpness, and voids appear at the part of solid print.

TABLE 4

| | Scumming | Fixing performance | Print quality |
|---|---|---|---|
| Example 13 | A | A | A |
| Example 14 | A | A | A |
| Comp. Exa. 14 | C | C | C |
| Comp. Exa. 15 | C | C | C |
| Comp. Exa. 16 | A | C | B |
| Comp. Exa. 17 | C | C | C |

As will be clear from Table 4, the thermal transfer recording mediums of this invention in Examples 13 and 14 shows a good print quality and fixing performance even when the platen pressure is as low as 180 g/head, and also caused no scumming.

We claim:

1. A thermal transfer recording medium having at least one peel layer on a support and at least one heat-softening layer on said peel layer, and containing a coloring material in at least one layer of said peel layer and heat-softening layer, wherein the peel layer adjacent to said support contains a polyethylene glycol derivative.

2. The thermal transfer recording medium as described in claim 1, wherein the peel layer adjacent to said support is formed by hot-melt coating.

3. The thermal transfer recording medium as described in claim 1, wherein the peel layer adjacent to said support is formed by coating a solution obtained by dispersing or dissolving components for constituting said peel layer in an organic solvent.

4. The thermal transfer recording medium as described in claim 1, wherein the peel layer adjacent to said support is formed by coating an aqueous emulsion comprising components for constituting said layer.

5. The thermal transfer recording medium as described in claim 1, wherein said heat-softening layer is formed by coating an aqueous emulsion comprising components for constituting said layer.

6. The thermal transfer recording medium as described in claim 1, wherein said heat-softening layer is formed by hot-melt coating.

7. The thermal transfer recording medium as described in claim 1, wherein the peel layer adjacent to said support is formed by hot-melt coating, and said heat-softening layer is formed by coating an aqueous emulsion comprising components for constituting said layer.

8. The thermal transfer recording medium as described in claim 1, wherein said polyethylene glycol derivative contained in the peel layer adjacent to said support is contained in an amount ranging from 1 to 50% by weight based on components for constituting said peel layer.

9. The thermal transfer recording medium as described in claim 8, wherein said polyethylene glycol derivative contained in the peel layer adjacent to said support is contained in an amount ranging from 4 to 30% by weight based on components for constituting said peel layer.

10. A thermal transfer recording medium having at least one peel layer on a support and at least one heat-softening layer on said peel layer, and containing a coloring material in at least one layer of said peel layer and said heat-softening layer, wherein the peel layer adjacent to said support contains polyoxyethylene monobehenyl ether.

11. A thermal transfer recording medium having at least one peel layer on a support and at least one heat-softening layer on said peel layer, and containing a coloring material in at least one layer of said peel layer and said heat-softening layer, wherein the peel layer adjacent to said support contains a mono or diester of polyethylene glycol.

12. The thermal transfer recording medium of claim 11 wherein the ester is derived from a fatty acid having 10 to 50 carbon atoms.

13. The thermal transfer recording medium of claim 12 wherein the fatty acid has 10 to 19 carbon atoms.

14. The thermal transfer recording medium of claim 11 wherein the mono- or diester of polyethylene glycol is a linear monoeneic acid, di-, tri- or tetraenic acid, or a synthetic aliphatic acid.

15. A thermal transfer recording medium having at least one peel layer on a support and at least one heat-softening layer on said peel layer, and containing a coloring material in at least one layer of said peel layer and said heat-softening layer, wherein the peel layer adjacent to said support contains polyethylene glycol monobehenate, polyethylene glycol distearate, polyethylene glycol monopalmitate, polyethylene glycol dibehenate, or polyethylene glycol laurate.

16. A thermal transfer recording medium having at least one peel layer on a support and at least one heat-softening layer on said peel layer, and containing a coloring material in at least one layer of said peel layer and said heat-softening layer, wherein the peel layer adjacent to said support contains an ether of monoalkyl or arylalkyl ether of polyoxyethylene ether.

17. The thermal transfer recording medium of claim 16 wherein the ether has 18 to 50 carbon atoms.

18. The thermal transfer recording medium of claim 16 wherein the ether is polyethylene glycol mono-p-nonylphenyl ether; polyethylene glycol monobehenyl ether; polyethylene glycol monocetyl ether or polyethylene glycol monooleyl ether.

19. The thermal transfer recording medium having at least one peel layer on a support and at least one heat-softening layer on said peel layer, and containing a coloring material in at least one layer of said peel layer and said heat-softening layer, wherein the peel layer adjacent to said support contains an ether or ester derivative of an ether of monoalkyl or arylalkyl ether of polyoxyethylene ether.

20. The thermal transfer recording medium of claim 19 wherein said ester is monobehenate of polyethylene glycol mono-p-nonylphenyl ether; monostearate of polyethylene glycol monostearyl ether; polyethylene glycol dibehenyl ether; or polyethylene glycol monooleyl ether monobehenyl ether.

21. A thermal transfer recording medium having at least one peel layer on a support and at least one heat-softening layer on said peel layer, and containing a coloring material in at least one layer of said peel layer and said heat-softening layer, wherein the peel layer adjacent to said support contains a polyoxyethylene ether of polyhydric alcohol.

22. The thermal transfer recording medium of claim 21 wherein the polyhydric alcohol is glycerol, propylene glycol, pentaerythritol, 1,5-sorbitan, 1,4-sorbitan, 3,6-sorbitan, isosorbide or mannitol.

23. A thermal transfer recording medium having at least one peel layer on a support and at least one heat-softening layer on said peel layer, and containing a coloring material in at least one layer of said peel layer and said heat-softening layer, wherein the peel layer adjacent to said support contains polyethylene monostearate of glycerol; di(polyoxyethylene monostearate) of glycerol; polyoxethylene monobehenyl ether of sorbitan monobehenate; polyoxyethylene oleate of butyl alcohol; a block copolymer of polypropylene glycol with polyoxyethylene glycol; polyoxyethylene ether of polystearate of polyglycerol; polyoxyethylene ether behenate of pentaerythritol distearyl ether; polyoxyethylene ether of sorbitan ester; polyoxyethylene ether of pentaerythritol; polyoxyethylene ether of polyglycerol ester; ester of polyoxyethylene ether of butyl alcohol ester; or polyoxyethylene ether of mannitol ester.

* * * * *